United States Patent [19]

Crownhart

[11] 4,146,280

[45] Mar. 27, 1979

[54] ROTATABLE DRAWER ASSEMBLY

[76] Inventor: Maurice Crownhart, Grantsburg, Wis. 54840

[21] Appl. No.: 802,642

[22] Filed: Jun. 2, 1977

[51] Int. Cl.[2] ..... A47B 81/00

[52] U.S. Cl. ..... 312/305; 312/197; 312/238; 312/333; 108/94

[58] Field of Search ..... 312/305, 238, 197, 11, 312/125, 202, 333; 108/94, 139, 101

[56] References Cited

U.S. PATENT DOCUMENTS

| | | | |
|---|---|---|---|
| 617,252 | 1/1899 | Levitt et al. | 312/125 |
| 1,248,682 | 12/1917 | Lauterbur | 312/305 |
| 1,291,366 | 1/1919 | Banks | 312/305 |
| 2,239,734 | 4/1941 | Pratt | 312/238 |
| 2,710,242 | 1/1955 | Chase | 312/197 |
| 3,075,820 | 1/1963 | Humphrey | 312/197 |
| 3,172,712 | 3/1965 | Allen | 312/197 |
| 3,281,197 | 10/1966 | Anderson | 312/238 |
| 3,628,844 | 12/1971 | Preston | 312/305 |
| 3,687,512 | 8/1972 | Alston | 312/330 |
| 3,868,157 | 2/1975 | Robinson | 312/305 |
| 3,982,800 | 9/1976 | Gorton et al. | 312/305 |

*Primary Examiner*—Victor N. Sakran
*Attorney, Agent, or Firm*—Allan O. Maki

[57] ABSTRACT

A revolving drawer set up for cabinets and the like having pivots located adjacent to the front of the drawer so that the entire drawer is opened sufficiently to permit lifting of the contents out of the drawer. The invention provides an improved catch mechanism for such assembly employing a detent which engages a spring plate having a depression therein to receive the detent and employs improved supporting hardware for the drawer assembly.

4 Claims, 6 Drawing Figures

ROTATABLE DRAWER ASSEMBLY

This invention relates to a system of cabinet drawers, rotatable on support hardware fully revolvable in either direction, with a stop that works to position the drawers when turning either clockwise or counterclockwise.

In the construction of storage facilities, little attention has been paid to the handicapped who are wheel-chair bound, but who with this present invention are able to secure contents from every portion of cabinets placed adjacent to a work area. Not only the handicapped, but also every other person will find contents easily accessible from a system of drawers that provides high-level use of storage areas, and flexibility of selected sizes and locations, whether permanently installed, or in portable units.

It is the principal object of this invention to provide a means for construction of drawers as units, both for installation in straight-wall, and corner cabinet structures, that can be supported by a set of universal hardware, and be utilized in both new and remodeling construction. It is a further object of the present invention to create revolving drawer units that will not only utilize space in corner base cabinets of kitchens, but also utilize upper cabinet corner spaces with revolving drawers whereas only conventional shelving, or turning "lazy susan" shelving has heretofore been available. It is a further object of the present invention to create revolving drawer units on a unitized basis, that as standalone cabinetry can be used as furniture items in bathrooms, bedrooms, offices and wherever storage space is needed. It is also a further object of this present invention to utilize techniques of injection molding to cast drawers for use with this revolving drawer system in full compatibility with hardware created through this invention.

The present invention contemplates use of a revolving drawer catch that permits drawers turning on their axis support standard to move either clockwise or counterclockwise unhampered, but when returning to their "closed" position will be secured by a detent and mating spring plate catch. A further object is to provide such a catch mechanism which operates without causing a sudden stop to the drawer and its contents.

The present invention further contemplates the use of drawer units in cabinet construction with the installation so made as to permit outer drawer fronts by placement and attachment to fit each of the many decorator schemes of selected wood patterns and colors, simulated wood patterns, and/or panels to match other drawers and doors.

The invention is illustrated by way of examples and with reference to the accompanying drawings, in which.

Figure 1:
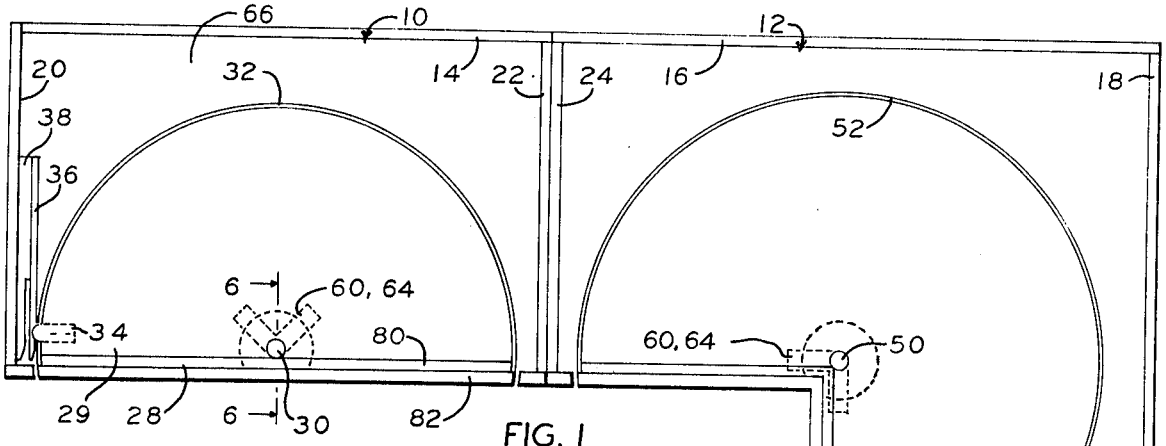
FIG. 1 is a top view of a pair of cabinet assemblies utilizing the present invention with the cabinet top removed.

Referring specifically to the drawings, numerals 10 and 12 generally indicate cabinet units utilizing revolving drawers in accordance with the present invention. Units 10 and 12 are provided with rear walls 14, 16 and 18 respectively. Assembly 10 has side walls 20 and 22 and assembly 12 has side walls 24 and 26. Assembly 10 has a plurality of approximately semi-circular drawers 28 which are vertically mounted to form a column. Immediately behind the forward walls of drawers 28 is a vertical drawer support standard 30. The vertical axis standard 30 is concentric with the rear walls 32 of drawers 28 which are circular in configuration. At one side of each of drawers 28 is located a detent 34 which is associated with a spring plate 36 mounted on wall 20. Spring plate 36 is secured to a mounting support 38 which is in turn affixed to the side cabinet wall 20.

Figure 2:
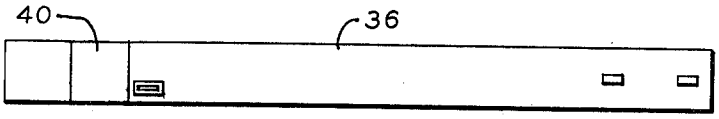
FIG. 2 is a side view of a catch spring plate used in conjunction with the drawers of the present invention.
Figure 3:
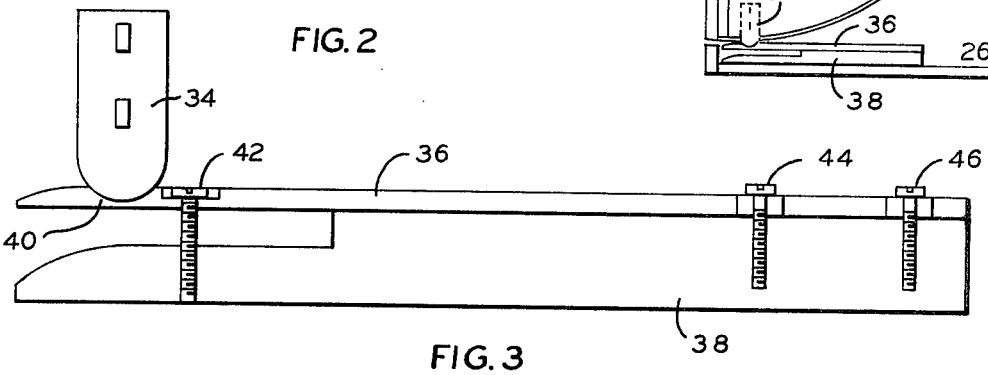
FIG. 3 is a top view of the catch spring and circular-ended detent.
Figure 4:
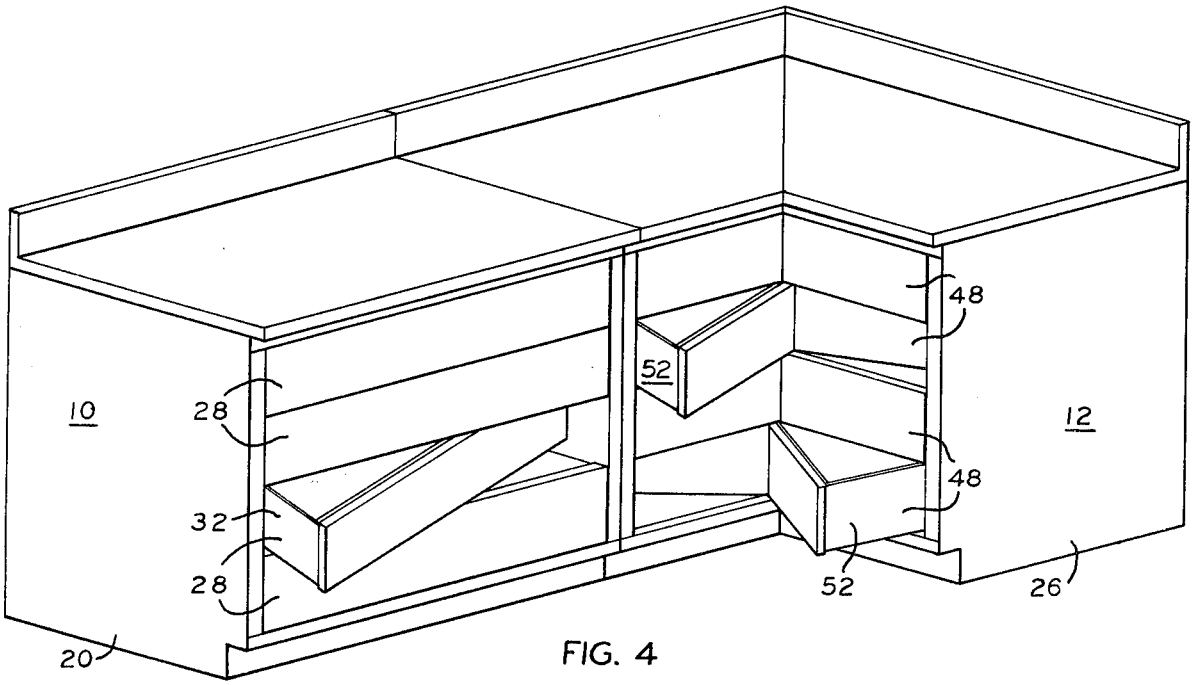
FIG. 4 is an isometric view of two cabinets placed together as in FIG. 1.

As shown in FIG. 3 spring plate 36 is mounted so that the central portion thereof can flex outwardly away from mounting supporting 38 when the end thereof is depressed by detent 34. Near the free end of spring plate 36 is a groove 40 adapted to catch and hold detent 34. The free end of spring plate 36 can be adjusted by means of screw 42. The head of screw 42 is preferrably recessed into the spring plate as shown and also preferably offset from the center thereof as illustrated in FIG. 2 in order to allow detent 34 to move along the spring surface without obstruction. As illustrated in FIG. 2 the groove for passage of screw 42 and mounting screws 44 and 46 may be elongated to provide for adjustability in locating spring plate 36. Detent 34 may also be provided with elongated slots as shown in FIG. 3 so that it may be adjustably located on the bottom of drawer 28.

Similar fashion drawer assembly 12 is provided with a plurality of drawers in the approximate shape of a three-quarter circle. Drawers 48 are similarly provided with an axis standard 50 positioned behind the drawer fronts which serves as a support standard for rotation of the drawers and which is concentric with the circular rear walls of the drawers 52. A similar catch assembly 34, 36 is provided adjacent to the side of each drawer to provide a stop mechanism for holding the drawers in closed position.

Figure 5:
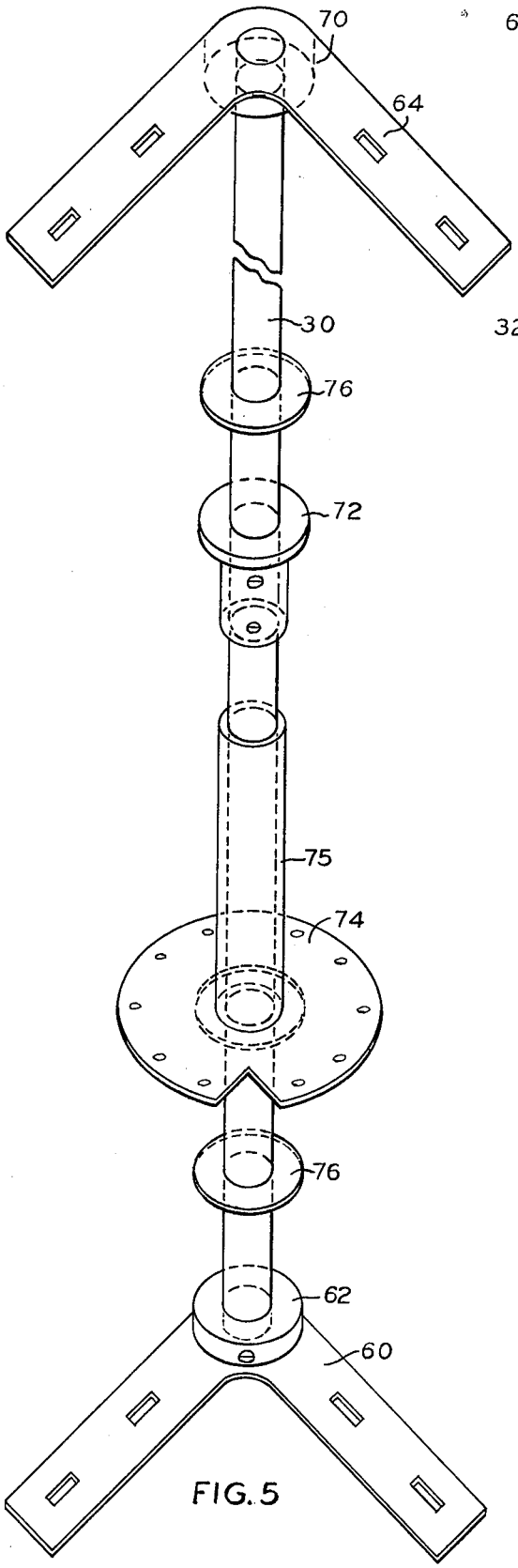
FIG. 5 is a fragmentary view illustrating the hardware components used in the cabinet drawer system.
Figure 6:
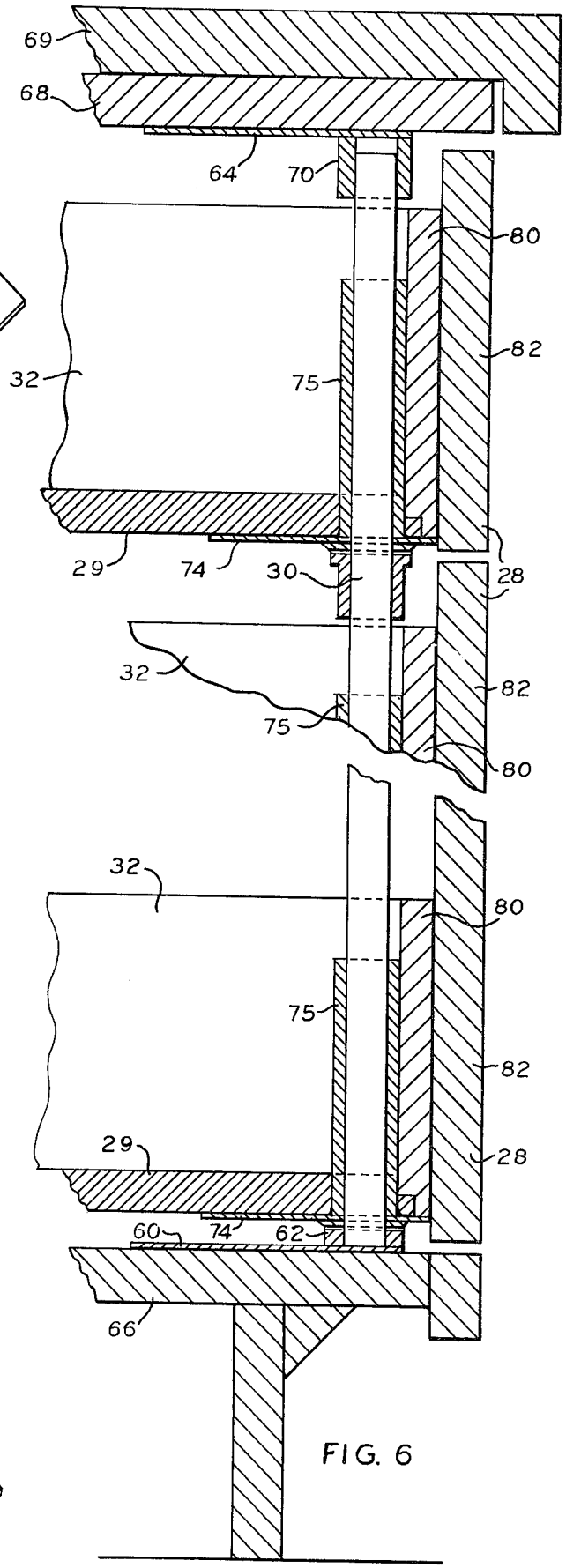
FIG. 6 is a fragmentary cross-sectional view along plane 6—6 in FIG. 1 showing the assembly of a drawer assembly and support hardware with parts cut away and with cabinet and countertops added.

The support hardware is shown more particularly with reference to FIGS. 5 and 6. Vertical axis support standard 30 (or 50) is supported at the bottom by means of a base plate 60 which has a collar 62 on one side thereof for rotatably holding the bottom of support 30. A top plate 64 of a similar configuration is provided to hold the top of standard 30. The "L" shaped configuration of the base and top support plates is an important feature of the invention as it provides a means for supporting the axis standard securely in place and yet readily can be utilized with either a semi-circular or three-quarter circular drawer shape as seen in FIG. 1. The legs of the "L" shape provide strength for the mounting of the assembly against twisting of the stacks of drawers when they are fully loaded. The inner edges of the legs of the "L" shape have an angle between them preferrably between 90° and 170° so that one support assembly can universally be used for different configurations of drawers.

As seen in FIG. 6, the base plate 60 is securely affixed by means of screws or the like to cabinet floor 66 while top plate 64 is securely affixed to the cabinet top 68.

Top plate 64 is also provided with a collar 70 which is preferrably of greater height than collar 62. The top plate 64 is also preferrably cut all the way through to permit it to slide over standard 30 to provide maximum room for inserting the standard in between the cabinet floor and cabinet top.

Adjustably affixed to standard 30 are a plurality of drawer support collars 72. Affixed by screws or similar means to the bottom 29 of each drawer 28 is a drawer support plate 74. A supporting friction washer 76 may optionally be provided for ease of rotation of support plates 74 over the top surface of drawer support collars 72 or the base support collar 62 in the case of the bottom drawer. Integral with support plates 74 is an elongated tubular portion 75 of the drawer support. The length of tubular portion 75 gives great strength to the drawer support against twisting. Countertop 69 is of conventional construction.

Each drawer 28 may optionally be provided with a double front as illustrated. Inner drawer front 80 is constructed or in the case of plastics integrally molded with the drawer bottom 20 and sides 32. An outer drawer front 82 may be provided. This gives the system the optional feature of being suitable for the provision of drawers having varying outer decors while using a standardized drawer construction. It will be appreciated that drawer fronts can be provided with wood, woodgrain, colored plastics, or may be custom tailored to coordinate with the interior decoration of the surroundings.

A further optional feature is the possibility that drawer support 74, 75 may be cast or injection molded as an integral part of the entire drawer.

Preferrably the axis standard rod 30 is constructed so as to have a flattened side on its entire length, so that set screws may conveniently be secured thereto for relocation of the collars along the standard as desired. Alternatively, a vertical depression may be provided to accept pointed set screws.

In operation the drawers may be conveniently rotated 360° if desired. By rotating the drawers 180° the entire contents are readily available to a user.

In order to mass produce drawers for use in the present invention, parts could be cast from a plastic material such as acetol and used in relatively standardized form so that similar parts can be used for drawers of different configurations. For example, support plate portion of the drawer support 74 may be notched at one side as indicated in FIG. 5. The notch accommodates three-quarter circular cabinets such as shown in cabinet 12 of FIG. 1. The front edge can readily be cut off to adapt the support plate for use of flat fronted drawers of the type illustrated in cabinet 10 of FIG. 1.

The foregoing embodiment is shown for purposes of illustration, however, it will be apparent that modifications will be suggested to those skilled in the art to fall within the purview of the invention.

What is claimed is:

1. In combination:

(a) a cabinet having rear and side walls;

(b) a plurality of drawers mounted for rotation in either direction about a standard positioned immediately within the front wall of the drawers, the bottom, rear, and side walls of said drawer being of circular configuration and being concentric with the standard;

(c) said standard being attached at opposite ends to upper and lower L shaped supporting brackets attached to the cabinet top and cabinet base, respectively, each of said brackets being provided with a collar on one side for receiving the standard;

(d) said standard being generally circular in cross-section;

(e) a collar below each of said drawers affixed to said standard;

(f) a drawer support means attached to each drawer having a flat supporting surface under the bottom of each drawer and an elongated tubular sleeve mounted on the standard for rotation, said tubular sleeve being integral with said supporting surface and extending upwardly in each of said drawers a majority of the depth of the drawer, to thereby reinforce said supporting surface against twisting, and (g) catch means on the sides of each of said drawers to hold the same in closed position, said catch means including a detent attached to a side of the drawer and a flat spring plate attached to the side wall of said cabinet having a depression therein to engage said detent and being adapted to flex to allow said detent to slide out of said depression for rotation of said drawers.

2. A combination according to claim 1, wherein the inner edges of said L shaped bracket have an angle of between 90° and 170°, whereby the L shaped brackets can be selectively employed with semi-circular and three-quarter circular drawer shapes.

3. A combination according to claim 1, wherein the drawers are made of plastic with said supporting surface and said sleeve being molded as an integral part of the drawer.

4. A combination according to claim 1, wherein said detent comprises a flat plate having an arcuate end, elongated slots provided in said plate whereby the detent is adjustably mounted radially on the under side of the circular drawer at the edge thereof; said spring plate including a mounting support secured to the side wall of the cabinet, adjusting bolt means securing one end portion of said spring plate to the mounting support at the base end thereof in a cantilevered manner, said bolt means extending through slots formed in the spring plate, whereby the spring plate can be adjusted relative to the mounting support in a direction normal to the detent, bolt means extending through the free end portion of said spring plate and into said mounting support, whereby the spring plate is adjustable horizontally toward and away from the center axis of the rotary drawer, and a groove formed in the free end portion of the spring plate adapted to receive the arcuate end of the detent, whereby the drawers are rotatable in either direction but stoppable at the exact closed position by the arcuate end of the detent engaging the groove in the spring plate.

* * * * *